US006011513A

United States Patent [19]

Wilson et al.

[11] Patent Number: 6,011,513

[45] Date of Patent: Jan. 4, 2000

[54] BEAMFORMING CIRCUITRY

[75] Inventors: Fiona Maihri Wilson, Ware; Robin Paul Rickard, Bishop's Stortford, both of United Kingdom

[73] Assignee: Northern Telecom Limited, Montreal, Canada

[21] Appl. No.: 09/198,222

[22] Filed: Nov. 23, 1998

[30] Foreign Application Priority Data

May 22, 1998 [GB] United Kingdom ..... 9811950

[51] Int. Cl.[7] ..... H01Q 3/22; H01Q 3/24; H01Q 3/26

[52] U.S. Cl. ..... 342/372; 333/81 R; 333/81 A

[58] Field of Search ..... 342/373, 372; 333/81 R, 81 A; 327/308, 503, 504

[56] References Cited

U.S. PATENT DOCUMENTS 4,903,032 2/1990 Multedo et al. ..... 342/441

5,117,377 5/1992 Finman .

5,565,823 10/1996 Fratti ..... 333/81 R

*Primary Examiner*—Theodore M. Blum

*Attorney, Agent, or Firm*—Lee, Mann, Smith, McWilliams, Sweeney & Ohlson

[57] ABSTRACT

Digital control of analogue beamformers utilising PIN diodes in a shunt circuit bi-phase attenuator arrangement is difficult because of the diodes extremely non-linear control response. There is disclosed a PIN diode circuit arrangement comprising a digital to analogue converter (DAC) with a reference voltage controller arranged to vary the DACs response to digital input signals to compensate for the PIN diode's non-linear response making this look substantially linear in the digital domain. The circuit preferably incorporates a feedback arrangement from the output of the DAC to its reference voltage input.

8 Claims, 7 Drawing Sheets

BEAMFORMING CIRCUITRY

FIELD OF INVENTION

The present invention relates to the control of PIN diodes and has particular but not exclusive application to beamforming circuitry for antennas.

PRIOR ART

Beamformers are used to adapt the shape of a transmission/reception pattern or beam of an antenna. This is extremely useful in adaptive array technology and communication systems generally. Dynamic beamformers provide the ability to modify or steer beam patterns for example to follow a mobile phone user.

Both digital and analogue versions of such dynamic beamformers are known. Digital beamformers tend to be both complex and expensive requiring significant processing overheads. Analogue beamformers are simpler and also have a greater dynamic range and bandwidth since the need to convert the signal to the digital domain is removed. The analogue beamformer can be controlled by digital words by the use of digital-to-analogue converters, for interfacing with digital circuitry.

Analogue beamformers can use a number of components to implement phase and/or amplitude control of incident RF signals. For example, PIN diodes, FET's, quadrature modulators, and commercial mixers are all used with various advantages and disadvantages. Quadrature modulators and commercial mixers are expensive compared to PIN diodes and FET's. PIN diodes are capable of handling much higher RF power levels than FET's, without exhibiting a power-dependent control low. U.S. Pat. No. 5,565,823 to Fratti shows a series connected PIN diode arrangement. However such series arrangements have high insertion losses and cannot be used as a biphase attenuator, a practically useful form of attenuator.

PIN diodes arranged in a shunt circuit have significantly lower levels of insertion loss than series arranged PIN diodes and can be used as biphase attenuators. However the shunt arrangement has a very non-linear control response and is therefore difficult to control digitally. Currently this non-linearity causes a loss of resolution in parts of the control low. This effect would in principle be partially offset by the use of high resolution digital-to-analogue converters, but this is expensive and the available resolution is limited.

OBJECT OF THE INVENTION

It is an object of the invention to provide an improved PIN diode control arrangement.

It is a further object of the invention to provide an improved analogue beamforming arrangement.

SUMMARY OF THE INVENTION

In a first aspect the present invention provides a circuit arrangement for phase and/or amplitude control of RF signals, the arrangement comprising:

a PIN diode shunt circuit;

a digital to analogue converter (DAC) having an output coupler to provide output voltage to the PIN diode shunt circuit, wherein said output voltage is arranged to vary the RF transfer function of the PIN diode shunt circuit; and a reference voltage controller connected to the reference voltage input of said DAC, wherein said controller is arranged to vary the reference voltage in order to vary the output voltage range of the DAC.

The reference voltage input of the DAC controls the full scale voltage output or output voltage range of the DAC.

Preferably the circuit arrangement further comprises a driving circuit connected between the output of the DAC and the PIN diode shunt circuit. Preferably the driving circuit comprises an OP AMP.

Preferably the PIN diode shunt circuit comprises two PIN diodes each connected between an arm of a 90 degree coupler and ground, and a bias resistor connected to each PIN diode coupler arm connection, the bias resistor being connected to the output of the DAC.

Preferably the reference voltage controller comprises feedback circuitry connected between the output and the reference voltage input of the DAC, wherein said feedback circuitry is arranged to vary the reference voltage in proportion to the output voltage of the DAC.

Alternatively, the reference voltage controller comprises a second DAC having an output connected to the reference voltage input of the first DAC, wherein the second DAC is arranged to vary the output voltage range of the first DAC.

In a second aspect the present invention provides a weighting network for a beamformer arrangement comprising:

a splitter which splits an input RF signal into an in-phase and a quadrature branch circuit;

a combiner which combines the in-phase and quadrature branch circuits;

wherein each branch circuit comprises a circuit arrangement for phase and/or amplitude control of RF signals, the arrangement comprising:

a PIN diode shunt circuit;

a digital to analogue converter (DAC) having an output coupler to provide output voltage to the PIN diode shunt circuit, wherein said output voltage is arranged to vary the RF transfer function of the PIN diode shunt circuit; and a reference voltage controller connected to the reference voltage input of said DAC, wherein said controller is arranged to vary the reference voltage in order to vary the output voltage range of the DAC.

In a third aspect the invention provides a beamformer arrangement comprising a plurality of weighting networks each comprising:

a splitter which splits an input RF signal into an in-phase and a quadrature branch circuit;

a combiner which combines the in-phase and quadrature branch circuits;

wherein each branch circuit comprises a circuit arrangement for phase and/or amplitude control of RF signals, the arrangement comprising:

a PIN diode shunt circuit;

a digital to analogue converter (DAC) having an output coupler to provide output voltage to the PIN diode shunt circuit, wherein said output voltage is arranged to vary the RF transfer function of the PIN diode shunt circuit; and a reference voltage controller connected to the reference voltage input of said DAC, wherein said controller is arranged to vary the reference voltage in order to vary the output voltage range of the DAC.

Preferably the beamformer arrangement further comprises a PROM connected to the digital input of each DAC.

In a further inventive aspect the invention provides a method of operating a circuit arrangement for phase and/or amplitude control of RF signals, the arrangement comprising:

a PIN diode shunt circuit;

a digital to analogue converter (DAC) having an output coupler to provide output voltage to the PIN diode shunt circuit, wherein said output voltage is arranged to vary the RF transfer function of the PIN diode shunt circuit; and a reference voltage controller connected to the reference voltage input of said DAC, wherein said controller is arranged to vary the reference voltage in order to vary the output voltage range of the DAC;

the method comprising the step of:

varying the reference voltage of the DAC such that the RF transfer function of the PIN diode circuit varies substantially linearly in response to changes in the digital input of the DAC.

BRIEF DESCRIPTION OF THE DRAWINGS

In order that a greater understanding of the invention can be obtained, embodiments of the invention will now be described with reference to the accompanying drawings, by way of example only and without intending to be limiting, in which.

DETAILED DESCRIPTION

Figure 1:
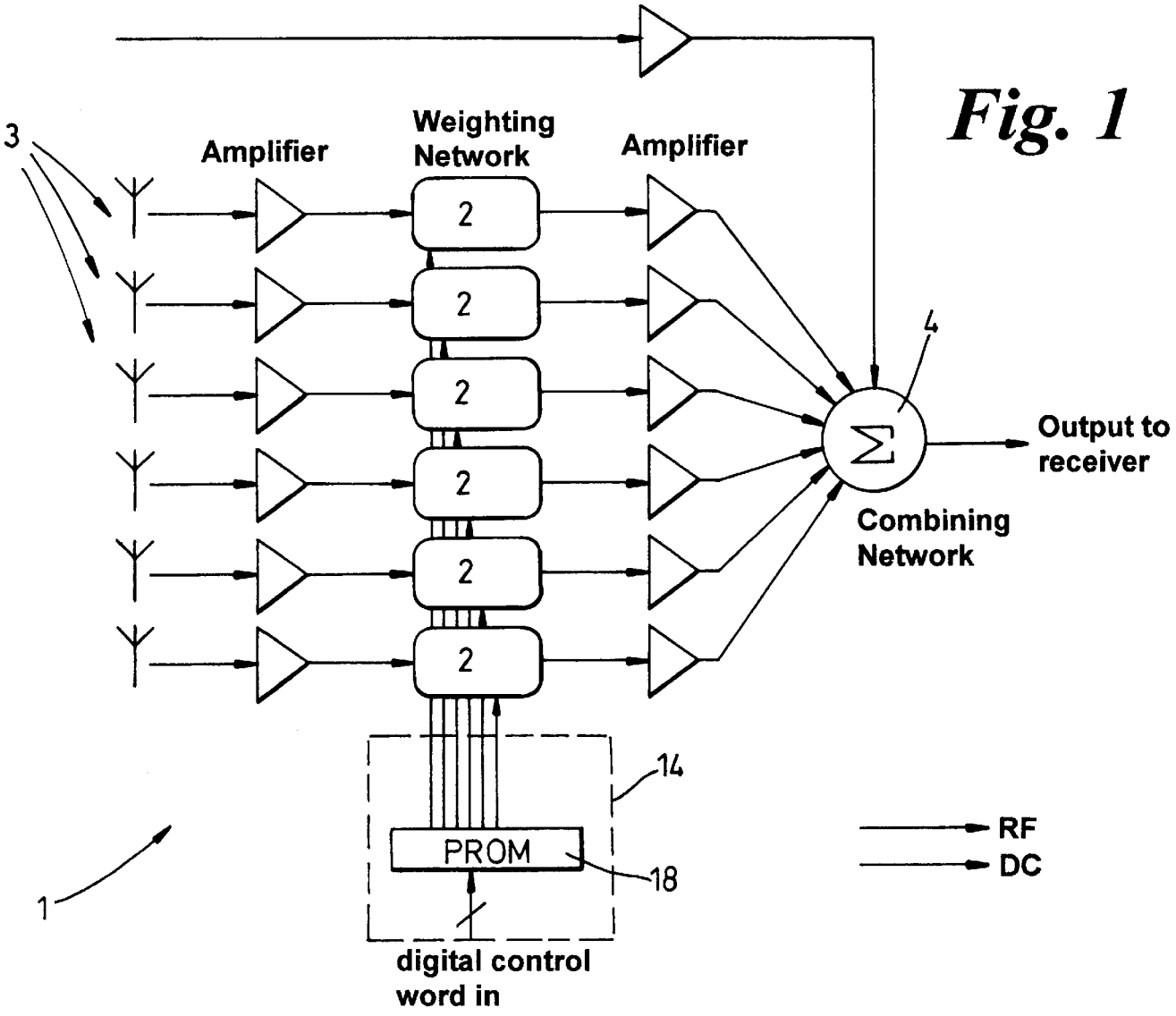
FIG. 1 shows an analogue beamforming arrangement using weighting networks.

FIG. 1 shows a block diagram of an analogue beamformer 1 on receive which consists of a weighting network 2 for each antenna element 3, and a combining network 4. A beamformer on transmit is analogous having instead of a combining network 4 a splitting network.

Each weighting network 2 is capable of altering the magnitude and/or phase of RF signals through it according to applied weights or bias. The weighting networks 2 of the invention utilise bi-phase attenuators implementing PIN diodes.

Figure 2A:
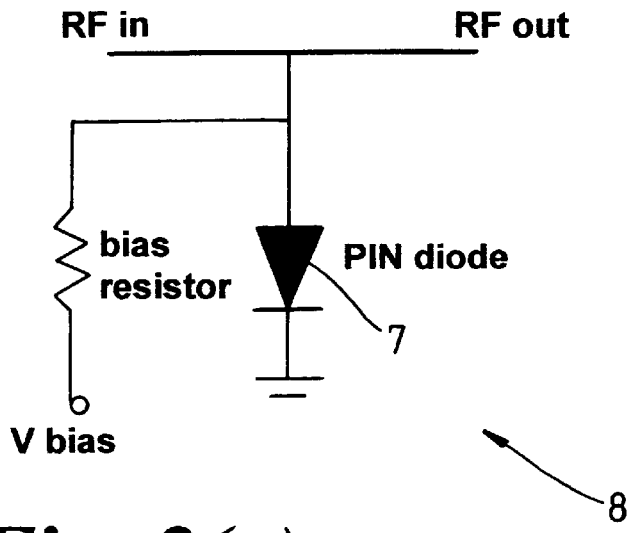
FIG. 2*a* and *b* show bi-phase attenuator arrangements using shunt circuit PIN diodes.
Figure 2B:
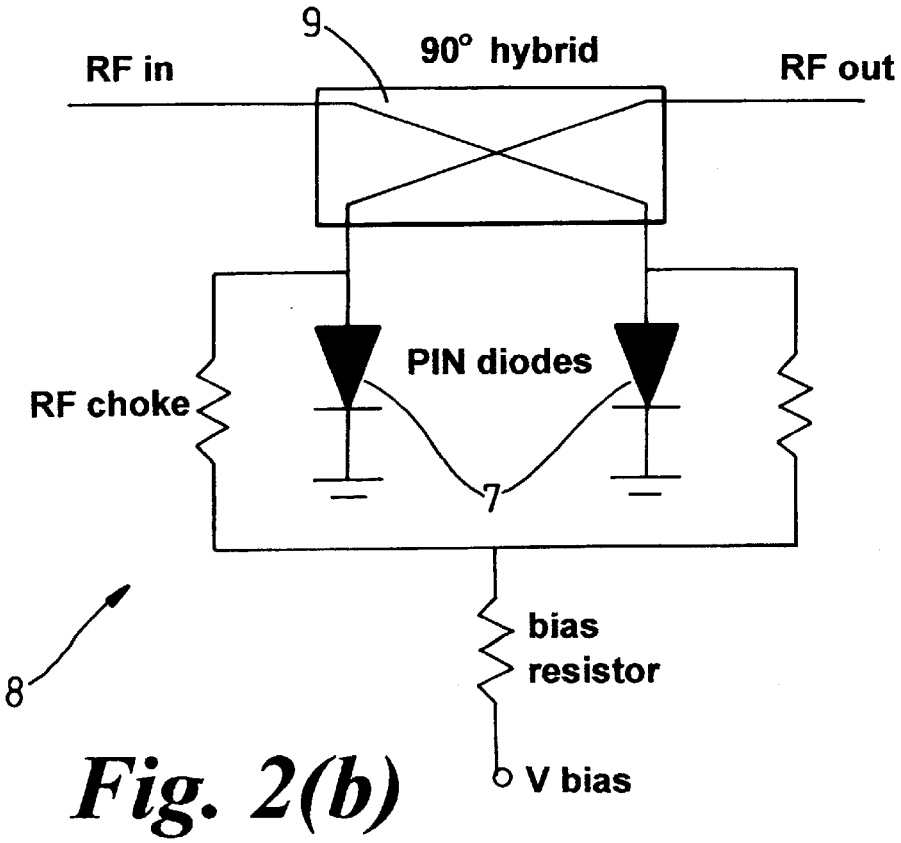

FIGS. 2*a* and 2*b* show two implementations of bi-phase attenuators 8 using PIN diodes 7 in shunt circuit arrangements. The bi-phase attenuators 8 form or are employed as part of the weighting networks 2. PIN diodes are a relatively cheap RF signal control device, they have good power handling characteristics and employ simple RF circuitry. PIN diodes are also less prone to weight bending than many other devices where very high power RF signals incident on the device will actually bias the device making its control unpredictable.

Figure 3:
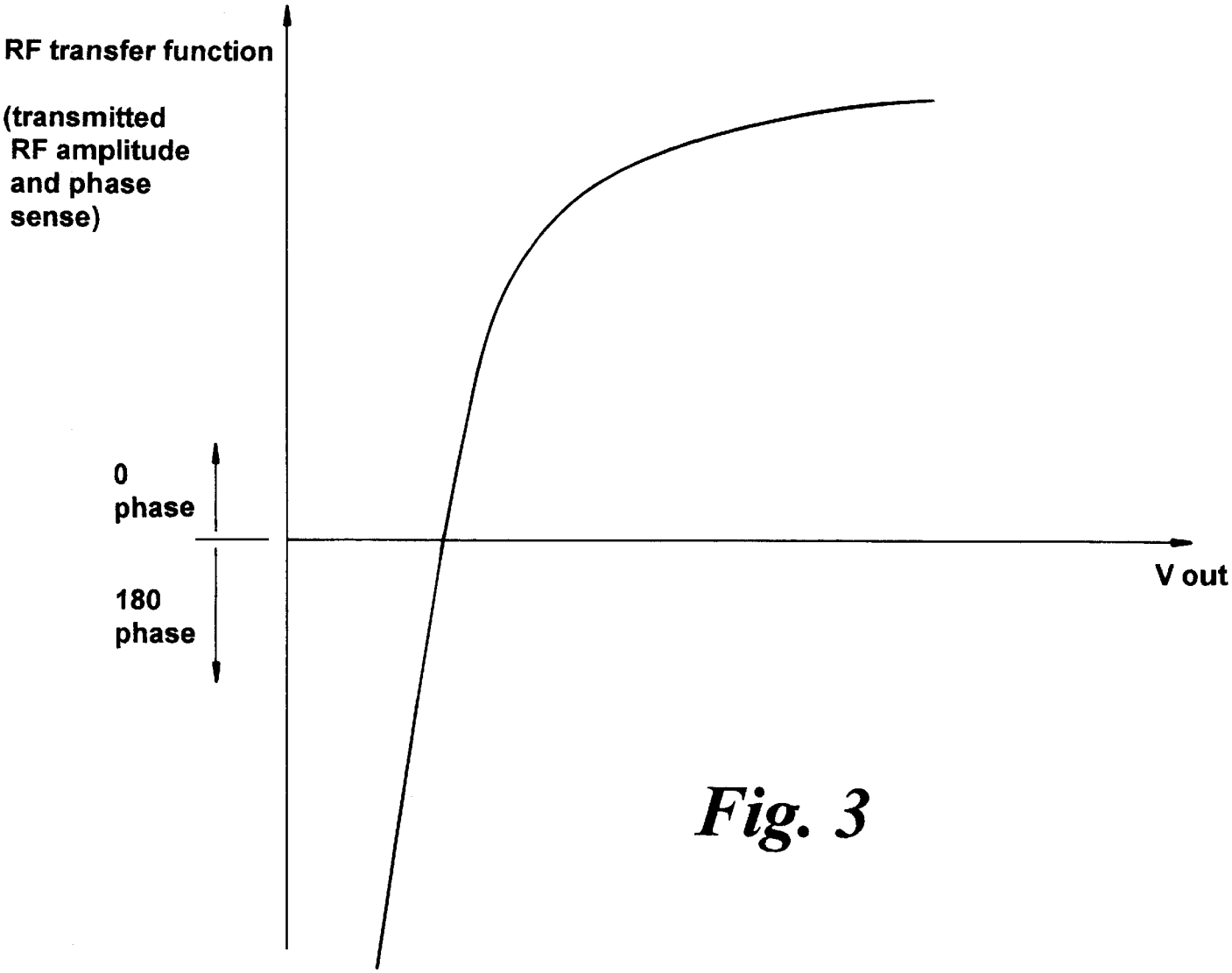
FIG. 3 shows a shunt circuit PIN diode bi-phase attenuator RF transfer function to control current response.

FIG. 2*a* shows a schematic of a basic PIN diode bi-phase attenuator 8. The amount of RF power transferred through the attenuator 8 is controlled by biasing ($V_{bias}$) the PIN diode 7, the control response of which is seen in FIG. 3. Note that negative power transfer implies a 180° phase shift.

FIG. 3 shows the control current to RF transfer function response of a PIN diode 7 in shunt circuit arrangement. This relationship is very non-linear making control of PIN diodes 7 in shunt circuit arrangements difficult using conventional DAC's for biasing. At low bias currents, a change in the value of the least significant bit of the driving DAC will cause a large change in the RF attenuation; that is the resolution of the beamformer is very poor. At high bias currents, a one bit change will cause an insignificant change in the RF attenuation; that is the resolution of the beamformer appears very good. In practice the effective resolution of the beamformer is much less than the number of bits in the DAC because of the non-linear controller. Prior to the invention, expensive high bit DACs could in principle be used to improve the resolution of the beamformer.

FIG. 2*b* shows a practical implementation of a bi-phase attenuator 8 using two identically biased PIN diodes 7 on the arms of a 90° hybrid coupler 9. Implementing the attenuator 8 in this way avoids unwanted reflections because looking into the device from either port, the opposite port is isolated. All power incident at the input is equally split between the PIN diodes 7, and all the power reflected from the PIN diodes combines in phase at the output port. Excess attenuation is minimised by this technique.

Figure 4:
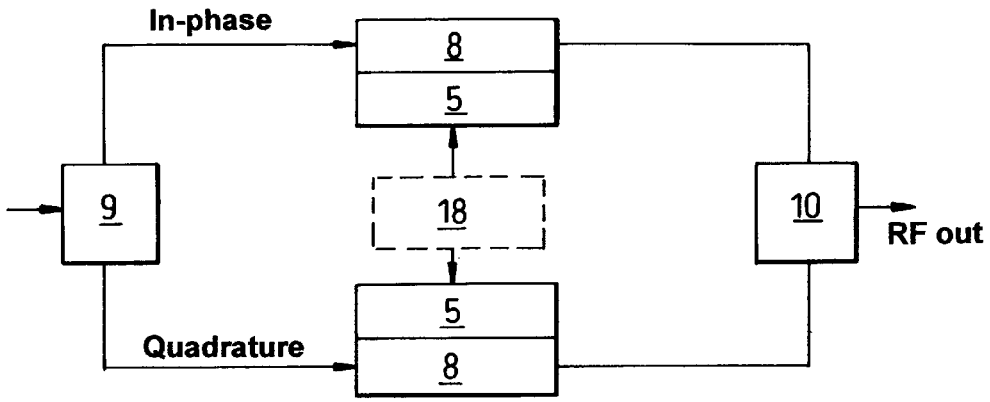
FIG. 4 shows a preferred weighting network for an analogue beamformer arrangement.

To rotate the phase of an RF signal by any amount between 0° and 360° the weighting network 2 of the invention includes in-phase and quadrature branches each utilising bi-phase attenuators as shown in FIG. 4. The in-phase and quadrature components of the weights are written separately and applied to the in-phase and quadrature components of an RF signal using bi-phase attenuators 8 such as those shown in FIG. 2*b*. This requires three 90° hybrid couplers 9 for each weighting network 2, one to perform the initial split of the RF signal into in-phase and quadrature components, and one for each bi-phase attenuator 8. Preferably broadside couplers are used. The weighting network 2 also requires a combiner 10 to combine the in-phase and quadrature signal components after weighting. Preferably a Wilkinson combiner is used.

Figure 5:
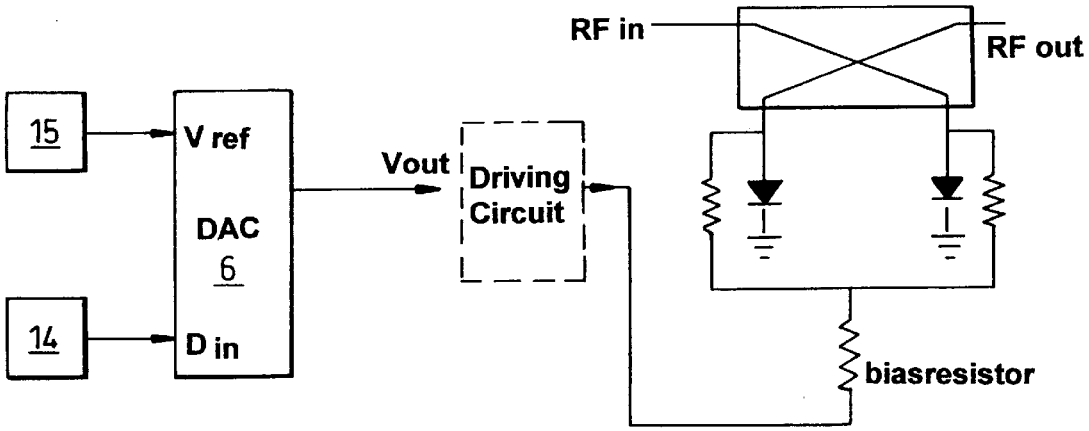
FIG. 5 shows a schematic block diagram of the principle of the invention.

Referring now to FIG. 5, a schematic block diagram of a controller 5 for a bi-phase attenuator 8 is there shown. Each bi-phase attenuator 8 requires a controller 5 to control the RF transfer function through the PIN diode circuit; that is the RF signal amplitude level and whether the phase of the RF signal is shifted by 180 degrees. The controller 5 biases the bi-phase attenuator 8 to implement digital weights written to that attenuator 8. Typically the weights will be written from a PROM 18 to each attenuator 8 to implement a particular beam pattern for the beamformer 1. The in-phase and quadrature weights for each weighting network 2 are written separately from the PROM 18.

The controller 5 of the invention is implemented using a DAC circuit which is arranged such that each bit change to the digital word input $D_{in}$ of the DAC 6 creates a substantially equal effect on the PIN diode's 7 RF transfer function, despite the PIN diode's 7 non-linear control current to RF transfer function response shown in FIG. 3. From the digital domain's point of view, the controller 5 effectively linearises the PIN diodes 7 RF transfer function to applied digital weight response.

The controller 5 comprises a DAC 6, digital input circuitry 14 and a reference voltage controller 15. The output voltage $V_{out}$ of the DAC 6 is used to control the PIN diode(s) 7 of a bi-phase attenuator 8 by driving the PIN diode's bias voltage. This is preferably done through an intermediate driving circuit. The digital input circuitry 14 is connected to the digital input $D_{in}$ of the DAC 6 which converts digital words supplied by the digital input circuitry 14 into analogue output voltages.

The digital input circuitry 14 is preferably a PROM 18 which provides a digital weight to each bi-phase attenuator 8 dependent upon a control word received from the beamformer's overall manager (not shown). The controller 5 for each bi-phase attenuator 8 converts this digital weight into a control voltage for controlling the bi-phase attenuator's 8 RF transfer function.

The analogue output voltage $V_{out}$ is a proportion of the DAC's 6 full scale output voltage, the proportion depending on the value of the digital word present at the DAC's digital input $D_{in}$. For example a digital word which is half the maximum digital value will produce an analogue voltage $V_{out}$ which is half the DAC's full scale output voltage. Conventionally the DAC's full scale output voltage is fixed and is set by $V_{ref}$.

The present invention however includes a reference voltage controller 15 which varies the reference voltage $V_{ref}$ of the DAC 6 to alter the DAC's full scale output voltage. This is used to alter the relationship between $V_{out}$ and the digital word input $D_{in}$, so that the relationship between $D_{in}$ and $V_{out}$ compensates for the non-linear relationship between the PIN diodes 7 control current (which is proportional to $V_{out}$) and the diode's RF transfer function.

Figure 6:
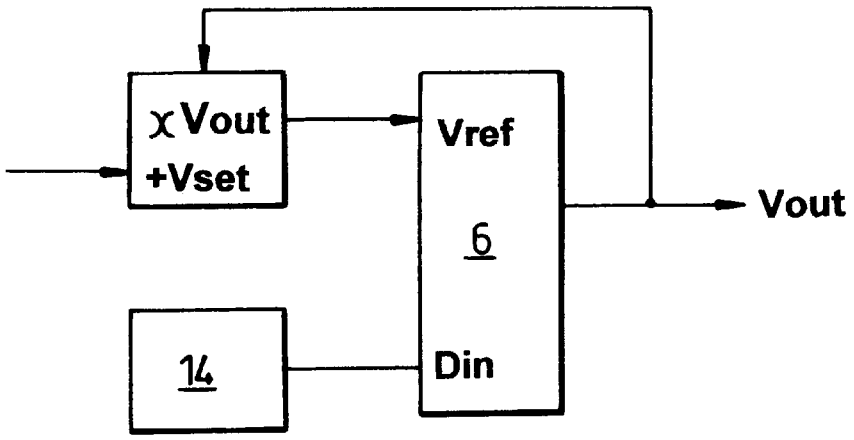
FIG. 6 shows a schematic block diagram of an analogue feedback implementation of the invention.
Figure 8:
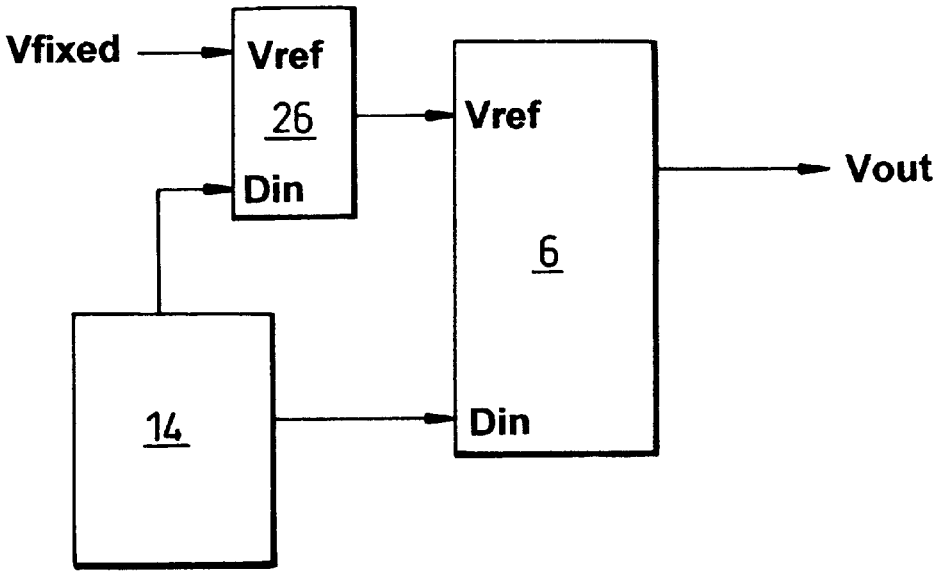
FIG. 8 shows a schematic block diagram of a digital control implementation of the invention.

The required non-linear relationship between $V_{out}$ and $D_{in}$ of the controller 5 can be implemented in a number of ways including a feedback arrangement as shown in FIG. 6. Alternatively $V_{ref}$ may be controlled using digital control means as shown in FIG. 8.

FIG. 6 shows the feedback arrangement of the controller 5 in which a proportion of the output voltage $V_{out}$ of the DAC 6 is fed back and added to an offset voltage $V_{set}$, the combination of which is added to the DAC's reference voltage input $V_{ref}$. This arrangement allows $V_{ref}$ to vary above and below $V_{set}$ by an amount proportional to the DAC's 6 output voltage $V_{out}$, which in turn is related to the value of the digital word at the digital input $D_{in}$ of the DAC 6. With appropriate choice of the amount of feedback, the required non-linear relationship between $V_{out}$ and $D_{in}$ can be obtained.

Figure 7:
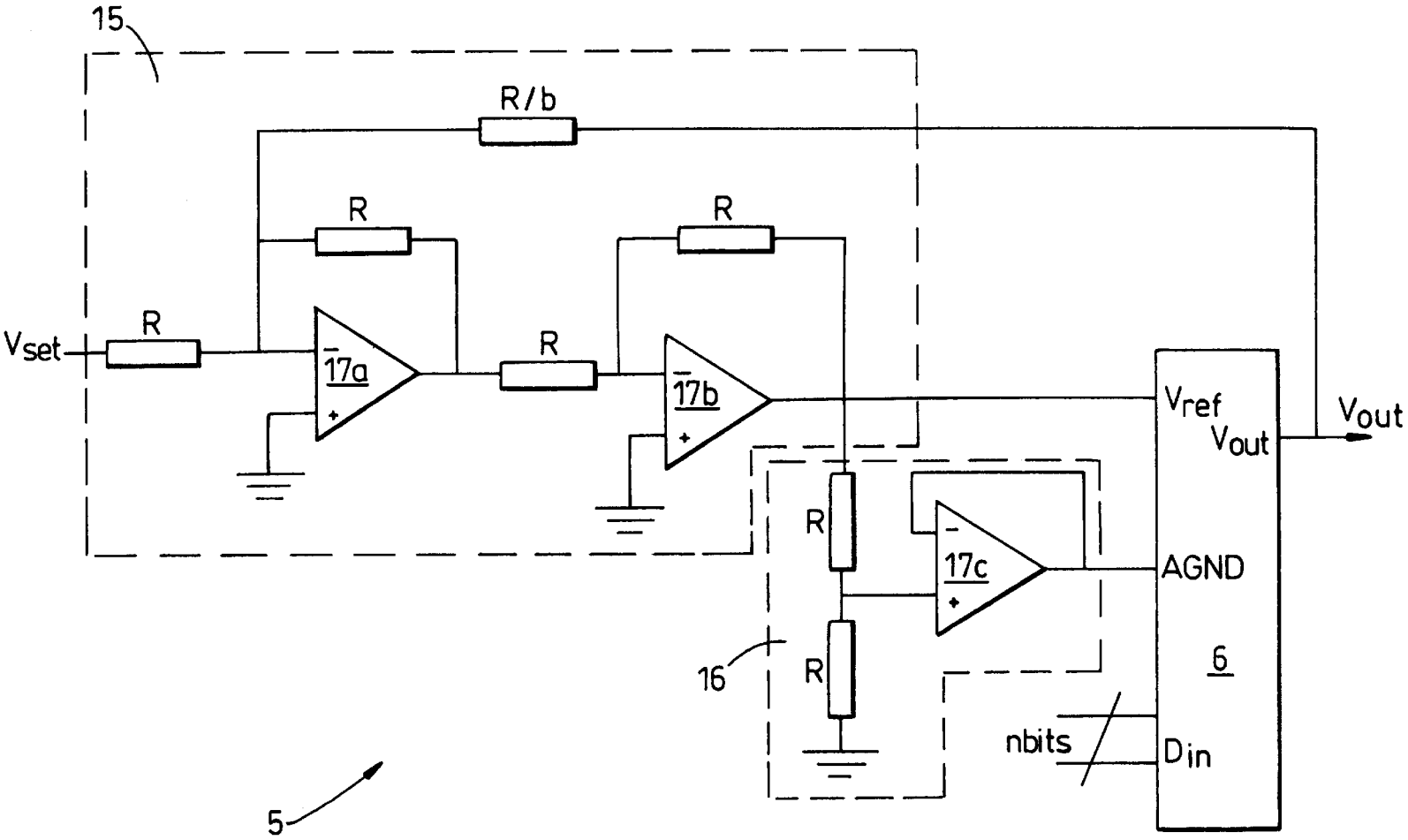
FIG. 7 shows a preferred practical feedback implementation of the invention.

FIG. 7 shows a practical implementation of a feedback controller 5 of the invention. In the reference voltage controller 15, a proportion of the output voltage $V_{out}$ from the DAC 6 is added to a fixed offset $V_{set}$ using an OP AMP 17*a* to add and scale these voltages. A second OP AMP 17*b* reverses the inversion caused by the first OP AMP 17*a*, and provides the reference voltage $V_{ref}$ for the DAC 6. A potential divider 16 halves this voltage to provide the analogue ground input (AGND) to the DAC 6. This ensures that the DAC 6 works in a uni-polar mode. Alternatively AGND could be set to OV wherein the DAC 6 will operate in a bi-polar mode.

The following analysis gives the response of the DAC 6 to a digital input: x is the proportion of full scale voltage deduced from $D_{in}$, the digital input word.

N=number of bits.

$V_{out}$=output voltage.

$V_{ref}$=reference voltage.

$V_{set}$=offset voltage.

b=feedback resistance as a proportion of R $$x = \frac{D_{in}}{2^N}$$

$$V_{out} = xV_{ref}$$

$$V_{out} = x(V_{set} + bV_{out})$$

$$V_{out} - bxV_{out} = V_{set}x$$

$$V_{out} = \frac{V_{set}x}{1 - bx}$$

The relationship between $V_{set}$ and b can be deduced by imposing the upper voltage limit. For example in a DAC supplied from a 5V source, the highest reliable drive voltage is 4.5V. This gives the condition that when:

$$x = 1V_{out} = 4.5$$

$$4.5 = \frac{V_{set}}{1 - b}$$

$$b = 1 - \frac{V_{set}}{4.5}$$

Figure 9:
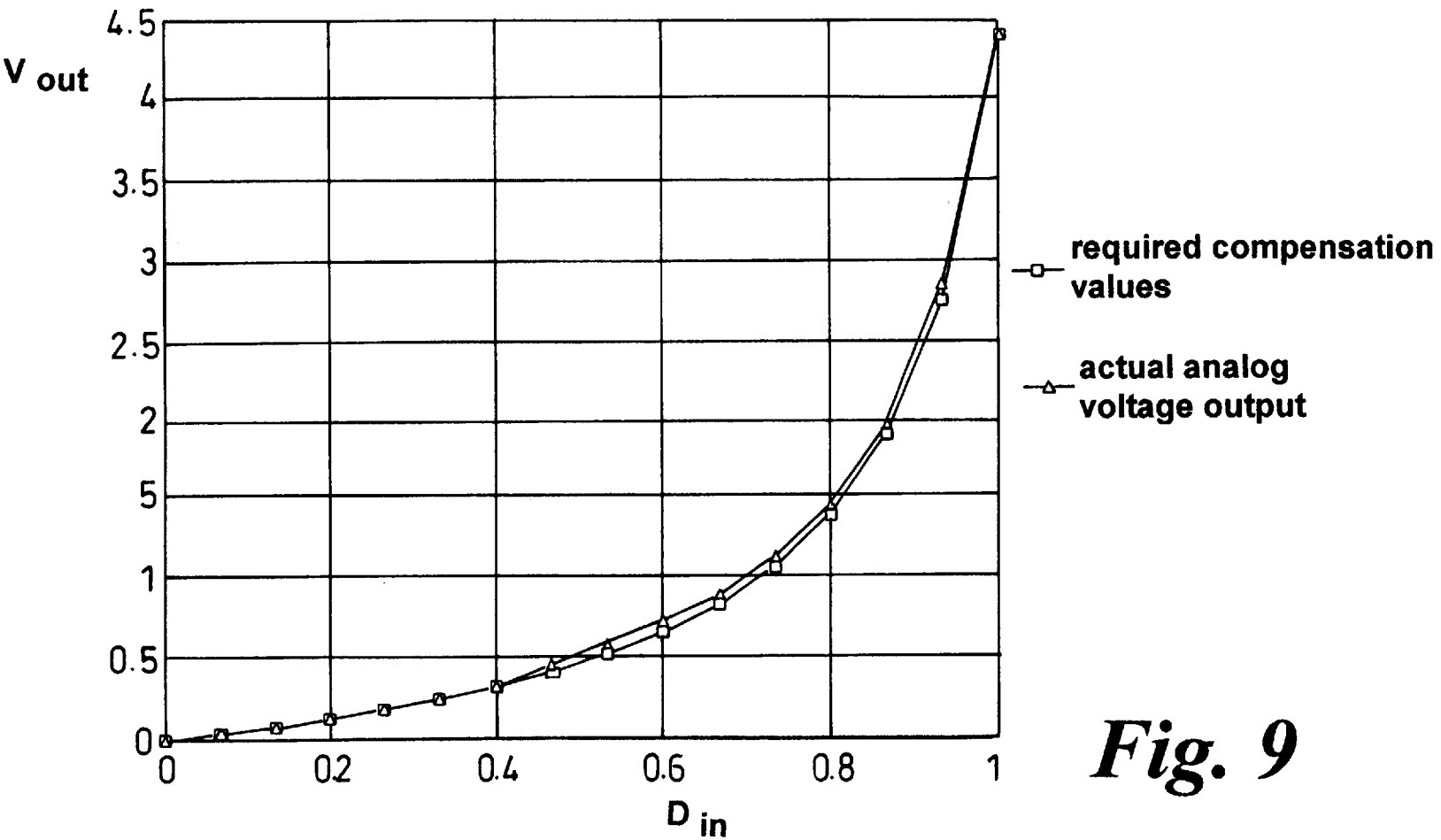
FIG. 9 shows the digital input to analogue output response of the preferred implementation.

A value for $V_{set}$ is found experimentally to minimise the mean square error between the output of the controlled response DAC circuit and the output required to compensate for the PIN diodes 7 non-linear control response. FIG. 9 shows the required non-linear compensating DAC 6 response and that obtained experimentally.

FIG. 8 shows an alternative embodiment of the invention which uses a digital control arrangement for the controller 5 in which the digital control circuitry 14 writes to a second DAC 26 in addition to the main DAC 6.

The second DAC 26 has a conventional fixed reference voltage and its output is connected to the reference voltage input $V_{ref}$ of the main DAC 6. This allows the digital input circuitry 14 to control the relationship between $V_{out}$ and $D_{in}$ The digital input circuitry 14 is preferably a PROM 18 which is programmed to write digital words to the auxiliary DAC 26 dependent on the words written to the main DAC 6 such that the main DAC's 6 $V_{out}$ to $D_{in}$ relationship is that shown in FIG. 9 which effectively compensates for the non-linear control current to RF transfer function of the PIN diode 7. Alternatively, the appropriate digital word for the auxiliary DAC26 can be calculated from the digital word written to the first DAC6

In use, the controller 5 is implemented with the bi-phase attenuator 8 of FIG. 2*b* and is arranged such that its digital input $D_{in}$ to analogue output $V_{out}$ response substantially compensates for the non-linear control response of the PIN diodes 7 in the bi-phase attenuator 8. In this way, each one bit change to the DAC 6 will have a substantially equal effect on the PIN diodes RF transfer function such that the PIN diodes control response appears substantially linear in the digital domain. This arrangement significantly improves the cost effectiveness of digitally implemented control of bi-phase attenuators 8 by allowing the use of cheaper low bit DACs.

Each bi-phase attenuator 8 forms part of the in-phase or quadrature branch circuits of a weighting network 2 as shown in FIG. 4, which allows phase and amplitude changes to be imposed on the in-phase and quadrature components of an RF signal incident on the weighting network 2. The weighting networks 2 themselves each form part of an analogue beamforming arrangement 1 as shown in FIG. 1, the transmission/reception pattern or beam of an antenna array being controllable digitally using this beamforming arrangement 1.

The foregoing describes the invention including a preferred form thereof. Alterations and modifications as will be obvious to those skilled in the art are intended to be incorporated within the scope hereof.

We claim:

1. A circuit arrangement for at least one of phase and amplitude control of RF signals, the arrangement comprising:

a PIN diode shunt circuit having a bias voltage input, and an RF transfer function which varies with said bias voltage;

a digital to analogue converter (DAC) having a reference voltage input and an output couple to said bias voltage input of the PIN diode shunt circuit;

and a reference voltage controller connected to the reference voltage input of said DAC, wherein said controller is arranged to vary the reference voltage in order to vary the output voltage range of the DAC output.

2. A circuit arrangement as claimed in claim 1, wherein the PIN diode shunt circuit comprises two PIN diodes each connected between an arm of a 90 degree coupler and ground, and a bias resistor connected to each PIN diode coupler arm connection, the bias resistor being connected to the output of the DAC.

3. A circuit arrangement as claimed in claim 1, wherein the reference voltage controller comprises feedback circuitry connected between the output and the reference voltage input of the DAC, wherein said feedback circuitry is arranged to vary the reference voltage in proportion to the output voltage of the DAC.

4. A circuit arrangement as claimed in claim 1, wherein the reference voltage controller comprises a second DAC having an output connected to the reference voltage input of the first DAC, wherein said second DAC is arranged to vary the output voltage range of said first DAC.

5. A weighting network for a beamformer arrangement comprising:

a splitter which splits an input RF signal into an in-phase and a quadrature branch circuit;

a combiner which combines the in-phase and quadrature branch circuits; wherein each branch circuit comprises:

a circuit arrangement for at least one of phase and amplitude control of RF signals, the arrangement comprising:

a PIN diode shunt circuit having a bias voltage input, and an RF transfer function which varies with said bias voltage;

a digital to analogue converter (DAC) having a reference voltage input and an output couple to said bias voltage input of the PIN diode shunt circuit and a reference voltage controller connected to the reference voltage input of said DAC, wherein said controller is arranged to vary the reference voltage in order to vary the output voltage range of the DAC output.

6. A beamformer arrangement comprising a plurality of weighting networks each comprising:

a splitter which splits an input RF signal into an in-phase and a quadrature branch circuit;

a combiner which combines the in-phase and quadrature branch circuits; wherein each branch circuit comprises:

a circuit arrangement for at least one of phase and amplitude control of RF signals, the arrangement comprising:

a PIN diode shunt circuit having a bias voltage input, and an RF transfer function which varies with said bias voltage;

a digital to analogue converter (DAC) having a reference voltage input and an output couple to said bias voltage input of the PIN diode shunt circuit and a reference voltage controller connected to the reference voltage input of said DAC, wherein said controller is arranged to vary the reference voltage in order to vary the output voltage range of the DAC output.

7. A beamformer arrangement as claimed in claim 6 further comprising a PROM connected to the digital input of each DAC.

8. A method of operating a circuit arrangement for at least one of phase and amplitude control of RF signals, the arrangement comprising:

a PIN diode shunt circuit having a bias voltage input, and an RF transfer function which varies with said bias voltage;

a digital to analogue converter (DAC) having a digital input, a reference voltage input and an output couple to said bias voltage input of the PIN diode shunt circuit and a reference voltage controller connected to the reference voltage input of said DAC, wherein said controller is arranged to vary the reference voltage in order to vary the output voltage range of the DAC output;

the method comprising the step of:

varying the reference voltage of the DAC such that the RF transfer function of the PIN diode circuit varies substantially linearly in response to changes in the digital input of the DAC.

* * * * *